United States Patent [19]

Smith et al.

[11] Patent Number: 4,557,197

[45] Date of Patent: Dec. 10, 1985

[54] PYROGEN IGNITER

[75] Inventors: James O. Smith; Ronald F. Vetter; George F. Sieg, all of Ridgecrest, Calif.

[73] Assignee: The United States of America as represented by the Secretary of the Navy, Washington, D.C.

[21] Appl. No.: 595,208

[22] Filed: Mar. 30, 1984

[51] Int. Cl.[4] ..... F42C 19/12

[52] U.S. Cl. ..... 102/202

[58] Field of Search ..... 102/202, 202.5, 530; 60/256

[56] References Cited

U.S. PATENT DOCUMENTS

| | | | |
|---|---|---|---|
| 2,561,670 | 7/1951 | Miller et al. | 102/202 |
| 2,921,521 | 1/1960 | LaHaye et al. | 102/202 |
| 2,934,014 | 4/1960 | Smith et al. | 102/202 |
| 2,995,088 | 8/1961 | Asplund | 102/202 |
| 4,080,901 | 3/1978 | Heier et al. | 102/202 |
| 4,391,196 | 7/1983 | Betts | 102/202 |

OTHER PUBLICATIONS

Cross-Sectional View of MK-133 Igniter.

*Primary Examiner*—Charles T. Jordan

*Attorney, Agent, or Firm*—Robert F. Beers; W. Thom Skeer; William J. Beres

[57] ABSTRACT

A pyrogen igniter for small nozzle applications has a high initial output. High initial output and long duration burning are achieved through utilization of a slow burning igniter main charge in conjunction with a booster pellet. A nozzle plate focuses and directs the output of the igniter as a gas jet while shielding the interior of the igniter from exterior temperature and pressure fluctuations which might otherwise operate to extinguish the igniter. A flush bridgewire/pressed prime igniter configuration and the elimination of loose powder in the igniter facilitates economical production and long shelf-life.

13 Claims, 3 Drawing Figures

PYROGEN IGNITER

BACKGROUND OF THE INVENTION

1. Field of the Invention

This invention relates to the ignition of a gas generator or rocket motor such as those commonly utilized in munitions applications.

2. Description of the Prior Art

Many munitions utilize gas generators to accomplish functions integral to their performance and operation. Among such munitions are certain air-launched guided missiles. In current guided missile applications existing gas generators and their igniters function satisfactorily under their prescribed circumstances of use. These igniters can be characterized as quick-opening and short-duration igniters. The reconfiguration of an existing gas generator into a new prototype gas generator for small nozzle applications demonstrated the need for a new igniter having significantly altered performance characteristics and capabilities than those offered by current igniters. Current igniters proved unable to ignite the prototype gas generator, within the environment in which the generator was to be employed, with a sufficient degree of reliability. In particular, an unacceptable number of ignition failures occurred when the existing igniters were utilized in attempts to ignite the prototype gas generator at low ambient temperatures. Additionally, the current igniters were susceptible to decompression extinguishment when utilized with the prototype gas generator. Still a further disadvantage of existing igniters is the utilization of loose powder in the powder train which has proven detrimental with respect to the service life and reliability of the igniters.

SUMMARY OF THE INVENTION

Current applications tolerate the use of short lived quick-opening igniters which operate at high pressure to ignite gas generators having small burn surface areas and free volumes. The prototype gas generator requires an igniter capable of operating for a long duration at significantly lower pressures and which is sufficiently insensitive to pressure and temperature fluctuations within the gas generator such that igniter extinguishment is unlikely. The prototype gas generator includes a propellant which is relatively difficult to ignite and has a comparatively large burning surface area and generator free volume. Also of importance in the development of an igniter for the prototype gas generator was the physical interchangeability of the new with existing igniters.

The igniter of the present invention is loosely based on the Mark 133 igniter successfully utilized in conjunction with the gas generator of the Sidewinder air-to air guided missile. An open ended housing includes, at one end, electrically conductive components through which a current is passed to initiate the ignition process. The opposite end of the housing is closed by a plate which includes a single orifice and which serves to shield the interior of the igniter from the effects of pressure and temperature fluctuations occurring within the gas generator. The output of the igniter exits the plate orifice where it is focused into a gas jet which directly impinges upon and erodes the grain face of the gas generator in order to ignite it.

A prime charge within the igniter is electrically initiated and in turn causes the igniter main charge to burn. The igniter main charge is configured in a two piece geometry to provide for a large burn surface and a burn of long duration at relatively low pressures. Additionally the components of the igniter main charge are cast solid pieces which eliminate the need for loose powder within the igniter and the disadvantages attendant with the use of loose powder.

The igniter of the present invention includes a booster pellet installed within a cavity in the igniter main charge. The booster pellet is highly energetic and significantly boosts the initial output of the igniter. It also serves to increase the reliability of ignition of the less energetic, harder to ignite igniter main charge.

While physically interchangeable with the Navy's MK 133 igniter, the igniter of the present invention is internally dissimilar and differs in function, operation and circumstances of use. The igniter herein described functions under conditions in which the MK-133 will not. Further, a flush bridgewire and pressed prime concept is demonstrated and utilized within the disclosed igniter which results in a more simple, inexpensive and easier to produce igniter.

It is thus an object of this invention to provide a more easily fabricated long duration igniter for a gas generator or other small nozzled combustion chamber application including usage as a squib for larger pyrogen igniters in large rocket motors.

It is a further object of this invention to provide a long burning igniter for a hard to ignite gas generator which is highly insensitive to pressure and temperature fluctuations occurring within the associated gas generator and which is physically interchangeable with existing igniters.

It is still a further object of this invention to provide an igniter for small nozzled combustion chamber applications, such as small rocket motors or larger igniters which eliminates the use of loose powder.

Finally, it is an object of this invention to provide a high output, relatively long duration igniter which is insensitive to external pressure and temperature fluctuations and which is capable of igniting a hard-to-ignite gas generator over the entire range of ambient temperatures in which the gas generator might be utilized.

The foregoing and other objects, advantages, the manner of operation and novel features of the present invention will be understood from the following detailed description when considered in conjunction with the appended drawings.

DESCRIPTION OF THE PREFERRED EMBODIMENT

While the igniter of the present invention will be described in the context of use with a gas generator, it is equally useful in rocket motor and other small nozzle applications.

Figure 1:
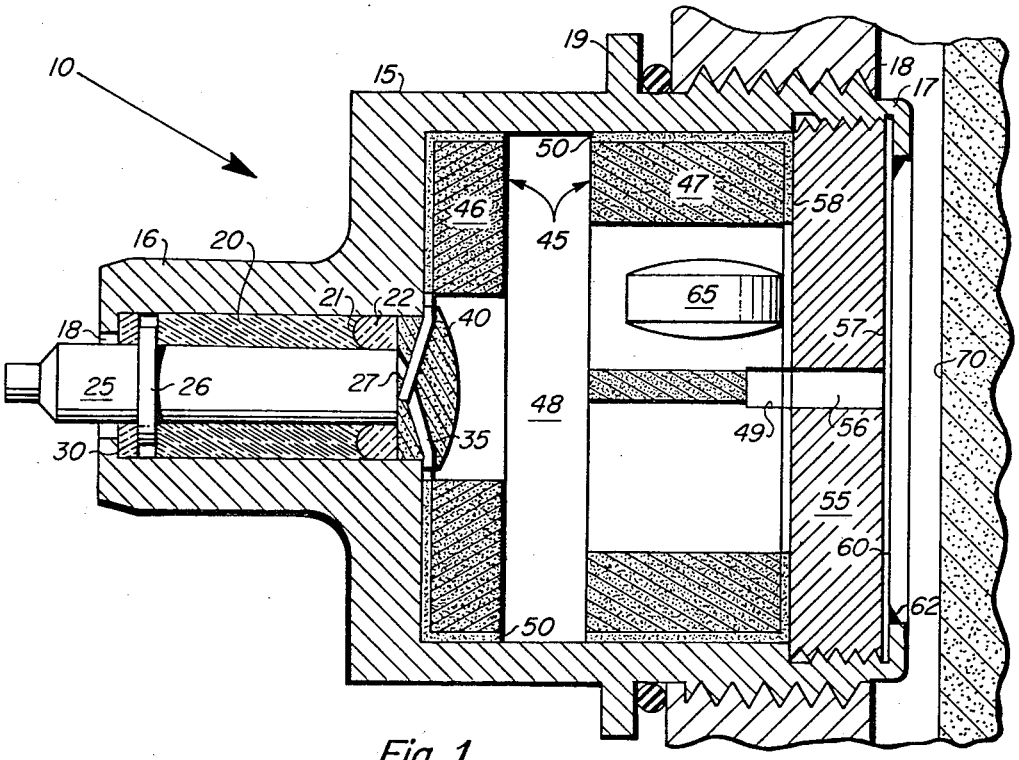
FIG. 1 is a cross-section of a first embodiment of the igniter of the present invention.

Referring to FIG. 1, pyrogen igniter 10, the device of the present invention, is illustrated. Housing 15 is fabricated from an electrically conductive material and includes an open neck portion 16 and an open base portion 17 having a diameter greater than that of open neck portion 16. Inserted within neck portion 16 is a nonconductive sleeve 20. Sleeve 20 is cylindrical and is fabricated of an insulative material such as glass or ceramic which is fused in place within neck portion 16. An electrically conductive pin 25 is inserted within sleeve 20 and protrudes from neck portion 16 of housing 15. Pin 25 includes an annular flange 26 which is dimensioned to prevent the exit of pin 25 from housing 15 during the firing of igniter 10. A ceramic washer 30 is utilized to retain and position pin 25 within sleeve 20 while maintaining pin 25 electrically insulated from housing 15. Pin 25 protrudes from housing 15 through an aperture 18 defined by neck portion 16 of housing 15. Aperture 18 has a diameter greater than that of pin 25 and housing 15 thus does not physically contact pin 25. An internal epoxy 22 is applied to sleeve 20 which fills the cavity between base 27 of pin 25 and neck portion 16 of housing 15.

An electrically conductive bridgewire 35 provides an electrical path between housing 15 and pin 25. Bridgewire 35 may be brazed or spot welded to both the base of pin 25 and neck portion 16 of housing 15. In this embodiment bridgewire 35 is a bent wire which facilitates the retention of a prime igniter charge 40 within neck portion 16 of housing 15.

In the embodiment illustrated in FIG. 1 prime igniter charge 40 is introduced into housing 15 as a slurry which fills and solidifies in neck end 16. As a result, bridgewire 35 becomes embedded within prime igniter charge 40. In operation, an electrical current is passed through bridgewire 35 which, consequently heats to the point of causing the ignition of prime igniter charge 40. The base 21 of insulator sleeve 20 may be concave or otherwise recessed to facilitate the bonding of epoxy 22 to sleeve 20. Internal epoxy 22 then defines a portion of the cavity within neck portion 16 which is occupied by prime igniter charge 40.

Figure 3:
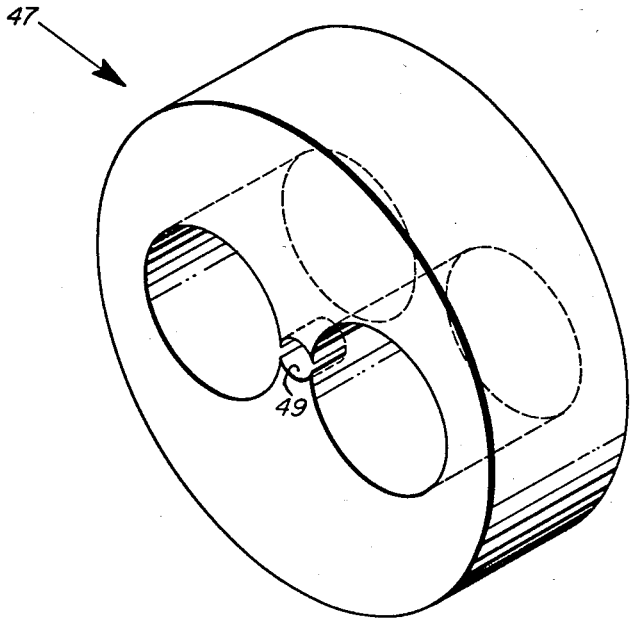
FIG. 3 is an isometric view of one portion of the igniter main charge more clearly demonstrating the geometry of the cavity defined by the charge.

Igniter main charge 45 is a two piece charge which includes a booster portion 46 and sustainer portion 47. Main charge 45 is characterized by a burning rate which is on the order of 0.25 in/sec at 70° F. and 1000 psi and is chosen to produce a minimal amount of slag. The preferred binder for the igniter main charge is hydroxy-terminated polybutadiene, an inert binder which is castable and permits high solids loading. The oxidizer in igniter main charge 45 is preferably ammonium perchlorate. Booster portion 46 and sustainer portion 47 are disposed at opposite ends of and are spaced apart within base portion 17 of housing 15 to provide a large burn surface area and a reaction chamber 48. Reaction chamber 48 consists of the cavity remaining within base portion 17 of housing 15 after booster portion 46 and sustainer portion 47 are installed within housing 15 of igniter 10. The two piece configuration of the igniter main charge is critical in achieving reliable ignition at ambient temperatures as low as −55° F. The two piece configuration provides a large burn surface area and a significant free space reaction chamber within the igniter which both enhances initial combustion and pressurization within igniter 10 and is necessary to ensure the success of gas generator ignition at low temperatures. Booster portion 46 and sustainer portion 47 are mounted within housing 15 utilizing an adhesive liner/restrictor 50. The geometry of sustainer portion 47 and the portion of reaction chamber 48 defined by sustainer portion 47 is more clearly illustrated in FIG. 3. Sustainer portion 47 includes counterbore 49, the function of which is later described.

Base portion 17 of housing 15 is effectively closed by the mounting of nozzle plate 55 within it. Nozzle plate 55 defines an exhaust orifice 56 through which the output of igniter 10 is directed in operation. As installed, nozzle plate 55 abuts and is adhesively bonded to sustainer portion 47 of the igniter main charge by adhesive liner/restrictor 50. Exhaust orifice 56 is extremely small, typically having a diameter of one-sixteenth of one inch, and communicates with reaction chamber 48 by way of counterbore 49 in sustainer portion 47. Nozzle plate 55 facilitates the development of a uniform output from igniter 10 despite fluctuating temperatures and pressures within the gas generator into which it opens by effectively shielding the interior of housing 15 from such fluctuations. This minimizes the likelihood of decompression extinguishment of igniter 10 before a steady state flame front can be established within the gas generator, a significant concern in gas generator and other small nozzle applications. The output of igniter 10 exits nozzle plate 55 through exhaust orifice 56 and is focused as an erosive gas jet which is directed at and impinges on grain face 70 of the gas generator grain. Nozzle plate 55 may be mounted within base portion 17 of housing 15 in any one of many conventional manners. The threadable engagement of plate 55 with housing 15 is illustrated in FIG. 1.

A seal 60 is mounted in base portion 17 of housing 15 to abut exterior face 57 of nozzle plate 55. Seal 60 may be a solid thin aluminum alloy disc retained in place by epoxy 62 which adheres to base portion 17 of housing 15. Seal 60 performs a dual function. First, while igniter 10 is in storage or otherwise uninstalled in a gas generator or rocket motor seal 60 provides a barrier between the environment exterior to igniter 10 and the interior of igniter 10 serving to prevent moisture and unwanted foreign matter from entering. The shelf-life of igniter 10 is thus enhanced. Second, in operation seal 60 facilitates the initial pressurization and ignition of igniter 10 and, by extension, the initial pressurization of the gas generator. Seal 60 has a thickness predetermined to result in its rupture when a predetermined pressure is developed within the igniter housing. Seal 60 particularly enhances the performance of igniter 10 in low temperature environments, the most difficult ignition circumstance. Initial gas temperatures, gas densities and heat transfer are significantly increased as a result of the utilization of seal 60.

The addition of a booster pellet 65 mounted within reaction chamber 48 in housing 15 causes a marked increase in the initial output of igniter 10 and increases the ignition reliability of the igniter main charge as well. Booster pellet 65 is preferably a boron/potassium nitrate pellet which is centered in igniter main charge 45 and retained by force fit. Booster pellet 65 may alternatively be adhesively mounted to nozzle plate 55 within reaction chamber 48. In operation booster pellet 65 interacts with prime igniter charge 40 and igniter main charge 45 to provide a high-output start. The initial high-output of igniter 10 is required to pressurize the gas generator chamber and is followed by a lower output of hot gases which maintain pressure within the gas generator until the gas generator main grain achieves steady-state burning with an established combustion zone over its entire surface.

Figure 2:
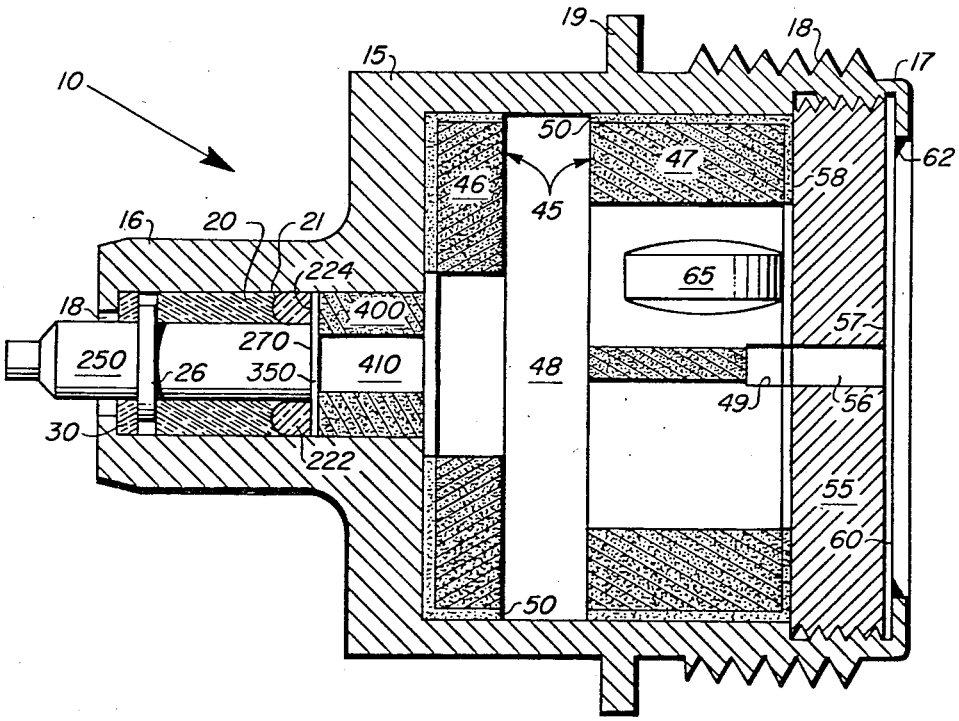
FIG. 2 is a cross-section of a second embodiment of the igniter of the present invention.

Referring now to FIG. 2, a second embodiment of igniter 10 is illustrated. Those reference numerals in FIG. 2 which are identical to the reference numerals of FIG. 1 refer to components which are identical in both embodiments. The remainder of the reference numerals of FIG. 2 identify components and features which, although not physically identical to the related components of the first embodiment, are similar to and carry out the function of those related components.

The essential differences between the embodiments of FIGS. 1 and 2 resides in the bridgewire/prime igniter charge arrangement. Specifically, pin 250 and epoxy 222 have flat bases 270 and 224, respectively. Flush bridgewire 350 is an unbent wire mounted across the flat surface formed by the flat bases of epoxy 222 and pin 250. As in the first embodiment bridgewire 350 provides an electrical path between housing 15 and pin 250. Bridgewire 350 may be brazed or welded in place to both pin 250 and housing 15. Prime igniter charge 400, in this embodiment, is introduced into neck portion 16 of housing 15 as a loose powder which is pressed into place. Igniter charge 400 defines a cavity 410 communicating with both bridgewire 350 and cavity 48 defined by igniter main charge 45. The existence of cavity 410 ensures that the prime igniter charge will not be expelled from neck portion 16 of housing 15 in response to the violent reaction which occurs when an electrical current is passed through bridgewire 350. With respect to the latter purpose, cavity 410 acts as a conduit by which ignition stresses, which would otherwise not be relieved if the prime igniter were a solid piece, are "conducted out" of the interface area where the bridgewire, prime igniter charge, pin and sleeve are in close proximity. The advantage of a flush bridgewire/pressed prime arrangement is primarily one of time and ease of fabrication and, by extension, expense in the fabrication of each igniter. Other advantages include ease of igniter weight control and extended environmental capability.

The igniter of the present invention achieves a four-fold increase in duration and a two-fold increase in operating pressure when compared to the output of existing igniters which proved unable to reliably ignite a prototype gas generator over the entire range of ambient operating temperatures. Whereas existing igniters for small nozzle applications may burn for approximately one-tenth of one second, the igniter herein disclosed operates for durations on the order of one-half of one second. Base portion 17 of housing 15 includes a set of threads 18 and a flange 19 which facilitates the physical and electrical interchangeability of igniter 10 with existing igniter devices. The simplified powder train of the device herein disclosed results in a reduction of fabrication expense and an extension in shelf life, particularly due to the elimination of loose powder within the igniter. The igniter of the present invention is a candidate for use where a high output and extended duration is required in a small nozzle application.

We claim:

1. A pyrogen igniter comprising:

an electrically conductive housing, said housing having an open neck portion and an open base portion;

an insulator sleeve mounted in said neck portion of said housing;

an electrically conductive pin mounted in said insulator sleeve, said pin protruding from said neck portion of said housing;

an electrically conductive bridgewire, said bridgewire mounted in said neck portion of said housing, said bridgewire providing an electrical path between said housing and said pin;

a prime igniter charge, said charge introduced into said neck portion of said housing as a slurry, said slurry solidifying in said neck portion around said bridgewire with the result that said bridgewire is embedded in said prime igniter charge;

a nozzle plate having an exterior face and an interior face and defining an exhaust orifice of predetermined diameter, said nozzle plate mounted in said base end of said housing, said nozzle plate focusing the output of said igniter as a gas jet and shielding the interior of said igniter from external pressure and temperature fluctuations; and an igniter main charge mounted in said base portion of said housing, said igniter main charge including a booster portion juxtaposed said prime igniter charge and a sustainer portion juxtaposed said nozzle plate, said igniter main charge defining a reaction chamber within said housing, said reaction chamber communicating with said prime igniter charge and said exhaust orifice defined by said nozzle plate.

2. The pyrogen igniter according to claim 1 further comprising a rupturable moisture/pressurization shield, said shield mounted in said base portion of said housing and abutting said exterior face of said nozzle plate, said shield sealing the interior of said housing from the environment external to said igniter until ruptured, said shield selected to be rupturable in operation when pressure within said housing reaches a predetermined level.

3. The pyrogen igniter according to claim 2 wherein said igniter further comprises a booster pellet mounted in said reaction chamber defined by said igniter main charge, said booster pellet reacting with said igniter main charge and said prime igniter charge to increase the initial output of said igniter and increase the reliability of ignition of said igniter main charge.

4. The pyrogen igniter according to claim 3 wherein said igniter main charge is mounted in said housing utilizing an adhesive liner and includes a hydroxy-terminated polybutadiene binder and an ammonium perchlorate oxidizer.

5. The pyrogen igniter according to claim 3 wherein said booster pellet is a boron/potassium nitrate pellet.

6. The pyrogen igniter according to claim 4 wherein said booster pellet is a boron/potassium nitrate pellet and said booster and sustainer grains have a nominal burn rate of twenty-five hundredths of an inch per second at seventy degrees Fahrenheit and one thousand pounds per square inch pressure.

7. A pyrogen igniter comprising:

an electrically conductive housing having an open neck portion and an open base portion;

an insulator sleeve mounted in said neck portion of said housing;

an electrically conductive pin having a base face, said base face of said pin being flush with said base face of said sleeve and said pin protruding from said neck portion of said housing;

an electrically conductive bridgewire mounted in said neck portion of said housing, said bridgewire providing an electrical path between said pin and said housing and being a straight wire mounted flush with said base face of said pin;

a prime igniter charge, said prime igniter charge pressed into said neck portion of said housing and into contact with said bridgewire and said base face of said pin;

a nozzle plate having an exterior face and an interior face and defining an exhaust orifice of predetermined diameter, said nozzle plate mounted in said base end of said housing, said nozzle plate focusing the output of said igniter as a gas jet and shielding the interior of said igniter from external pressure and temperature fluctuations; and an igniter main charge mounted in said base portion of said housing, said igniter main charge including a booster portion juxtaposed said prime igniter charge and a sustainer portion juxtaposed said nozzle plate, said igniter main charge defining a reaction chamber within said housing, said reaction chamber communicating with said prime igniter charge and said exhaust orifice defined by said nozzle plate.

8. The pyrogen igniter according to claim 7 further comprising a rupturable moisture/pressurization shield, said shield mounted in said base portion of said housing and abutting said exterior face of said nozzle plate, said shield sealing the interior of said housing from the environment external to said igniter until ruptured, said shield selected to be rupturable in operation when pressure within said housing reaches a predetermined level.

9. The pyrogen igniter according to claim 8 wherein said igniter further comprises a booster pellet mounted in said reaction chamber defined by said igniter main charge, said booster pellet reacting with said igniter main charge and prime igniter charge to increase the initial output of said igniter and increase the reliability of ignition of said igniter main charge.

10. The pyrogen igniter according to claim 9 wherein said igniter main charge is mounted in said housing utilizing an adhesive liner and includes a hydroxy-terminated polybutadiene binder and an ammonium perchlorate oxidizer.

11. The pyrogen igniter according to claim 9 wherein said booster pellet is a boron/potassium nitrate pellet.

12. The pyrogen igniter according to claim 10 wherein said booster pellet is a boron/potassium nitrate pellet and said booster and sustainer grains have a nominal burn rate of twenty-five hundredths of an inch per second at seventy degrees Fahrenheit and one thousand pounds per square inch pressure.

13. The pyrogen igniter according to claim 9 wherein said prime igniter charge defines a cavity, said cavity communicating with said bridgewire and said reaction chamber defined by said igniter main charge.

* * * * *